US005797248A

United States Patent [19]

Hetherington et al.

[11] Patent Number: 5,797,248

[45] Date of Patent: Aug. 25, 1998

[54] MANUAL CAPSULE FILLING DEVICE

[75] Inventors: Michael Hetherington, Ontario; William Wassenaar, Toronto, both of Canada

[73] Assignee: Willem Wassenaar, Toronto, Canada

[21] Appl. No.: 851,686

[22] Filed: May 6, 1997

[51] Int. Cl.[6] ..... B65B 1/06; B65B 1/36; B65B 67/00; B65B 67/02

[52] U.S. Cl. ..... 53/473; 53/281; 53/390; 141/247

[58] Field of Search ..... 53/468, 473, 281, 53/282, 266.1, 390, 503; 141/242, 244, 247, 387

[56] References Cited

U.S. PATENT DOCUMENTS

| | | | |
|---|---|---|---|
| 3,269,429 | 8/1966 | Fritts | 53/390 X |
| 3,435,589 | 4/1969 | Horton | 53/390 |
| 3,501,894 | 3/1970 | Hayashi et al. | 53/281 |
| 3,552,095 | 1/1971 | Inman | 53/390 |
| 3,794,088 | 2/1974 | Harvey | 53/390 X |
| 4,026,091 | 5/1977 | Pearson | 53/390 |
| 4,089,152 | 5/1978 | Zanasi | 53/281 |
| 4,122,651 | 10/1978 | Braverman | 53/390 |
| 4,685,271 | 8/1987 | Ringer et al. | 53/390 X |
| 5,321,932 | 6/1994 | Sundberg | 53/468 |

*Primary Examiner*—Horace M. Culver
*Attorney, Agent, or Firm*—Dvorak & Orum

[57] ABSTRACT

A capsule filling device includes a manually operated system of dispensing specific quantities of pharmaceutical or other suitable substance into capsules. A desired quantity of pharmaceutical is placed in a capsule by using interchangeable plates with set volumes of wells to measure specific quantities of pharmaceutical.

19 Claims, 7 Drawing Sheets

MANUAL CAPSULE FILLING DEVICE

FIELD OF THE INVENTION

This invention relates in general to capsule filling devices and more particularly to a manual capsule filling device.

BACKGROUND OF THE INVENTION

Pharmaceutical substances are generally available in tablet or capsule form and in a set dosage quantity or a limited range of dosages. However, the delivery of pharmaceuticals would be more effective if each individual patient was given a specific dose of pharmaceutical suitable for that patient. The suitable quantity of a particular pharmaceutical for a specific patient depends on such factors as their age, weight, gender and general health. Patients would benefit from having a specific quantity of pharmaceutical suited to their requirements. This invention provides a manual capsule filling device capable of filling capsules with a large range of quantities of pharmaceutical. In addition, this invention also allows for filling capsules with specific doses of one or more pharmaceuticals in each capsule.

Prior art capsule filling devices and methods of weighing powder have been devised. For example, Canadian Patent 494,695 is a capsule filling device in which a measured amount of pharmaceutical is placed on a spreader plate with wells, the depth of the wells being adjustable. The pharmaceutical is spread into the wells until it is flush with the tops of the wells, the spreader plate is covered with a funnel system and turned upside down to allow the medicine to funnel into capsules. No indication is given of how the depth of the wells is determined. U.S. Pat. No. 5,321,932 is a device to open and close capsules so that they may be filled, however, the method of filling the capsules is not described. U.S. Pat. No. 4,619,336 provides a method and apparatus for weighing doses of powder. This device feeds powder onto a weigh scale and stops the powder flow just below the desired weight at which point the feeding mechanism is stopped and the powder remaining is allowed to run into the weighing receptacle. This patent does not describe the filling of capsules.

Thus a manual capsule filling device which fills capsules with a specific desired quantity of pharmaceutical, or other substance to be placed in a capsule, is desirable.

SUMMARY OF THE INVENTION

An object of one aspect of the present invention is to provide an improved manual capsule filling device.

In accordance with one aspect of the present invention there is provided a capsule filling device comprising:

i) an upper housing;

ii) a dosage plate;

iii) a base plate; and iv) a capsule plate; the dosage plate, the upper housing and the base plate being arranged such that the upper housing is above the dosage plate and the base plate is below the dosage plate; the base plate being in engageable connection with and above the capsule plate; the capsule plate comprising capsule holder means to receive at least one open capsule bottom; the dosage plate being slidable between a first, a second and a third position, such that the second position is located between the first position and the third position; the upper housing, dosage plate and base plate each define at least one channel, the dimension of each channel permitting a pourable substance to be passed through each channel; the channels in the base plate align with the capsule holder means in the capsule plate; in first position, the channels in the upper housing align with the channels in the dosage plate such that a pourable substance may pass through the channels in the upper housing and the channels in the dosage plate; in second position the channels in the dosage plate are not aligned with the channels in the upper housing and the channels in the dosage plate are not aligned with the channels in the base plate; and in third position the channels in the dosage plate are aligned with the channels in the base plate such that a pourable substance may pass through the channels in the dosage plate and the channels in the base plate and into the open capsule bottoms in the capsule holders means.

The advantages of the present invention are the ability to manually fill capsules with specific quantities of pharmaceutical and also to fill capsules with more than one type of pharmaceutical. A further aspect of this invention is to fill capsules with specific quantities of pharmaceutical and no excipients, that is, a capsule is filled only with the pure pharmaceutical. This invention is also capable of filling capsules with substances other than pharmaceuticals.

BRIEF DESCRIPTION OF THE DRAWINGS

A detailed description of two embodiments are provided herein below with reference to the following drawings, in which.

Figure 1:
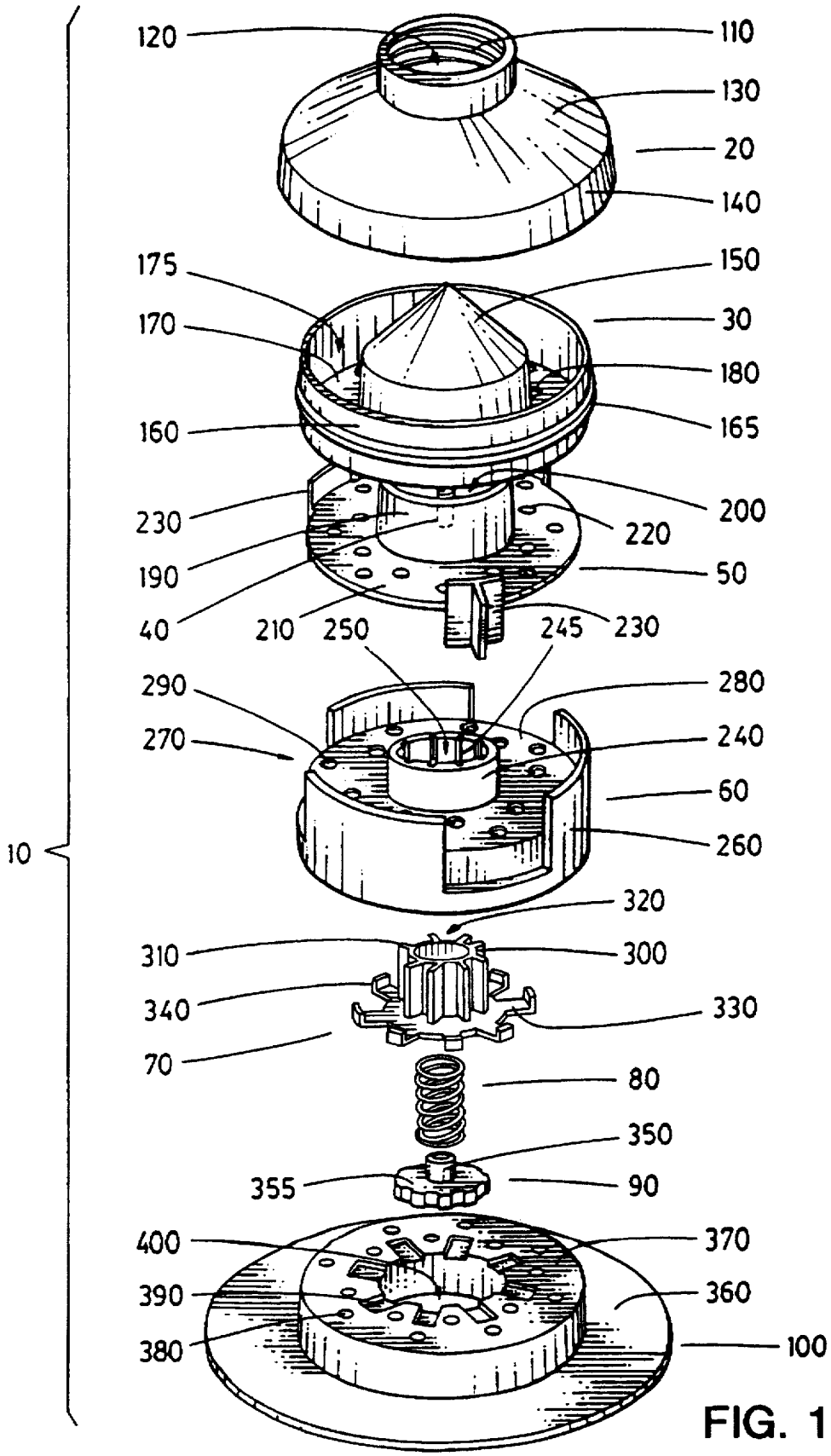
FIG. 1 is an exploded view of the capsule filling device in accordance with a first embodiment of the present invention.
Figure 2:
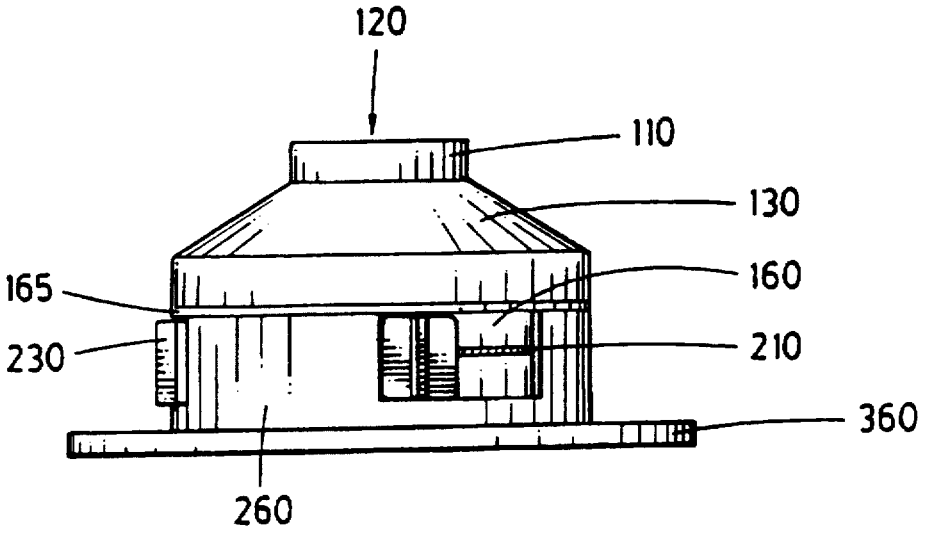
FIG. 2 is a side view of the capsule filling device of FIG. 1.
Figure 3:
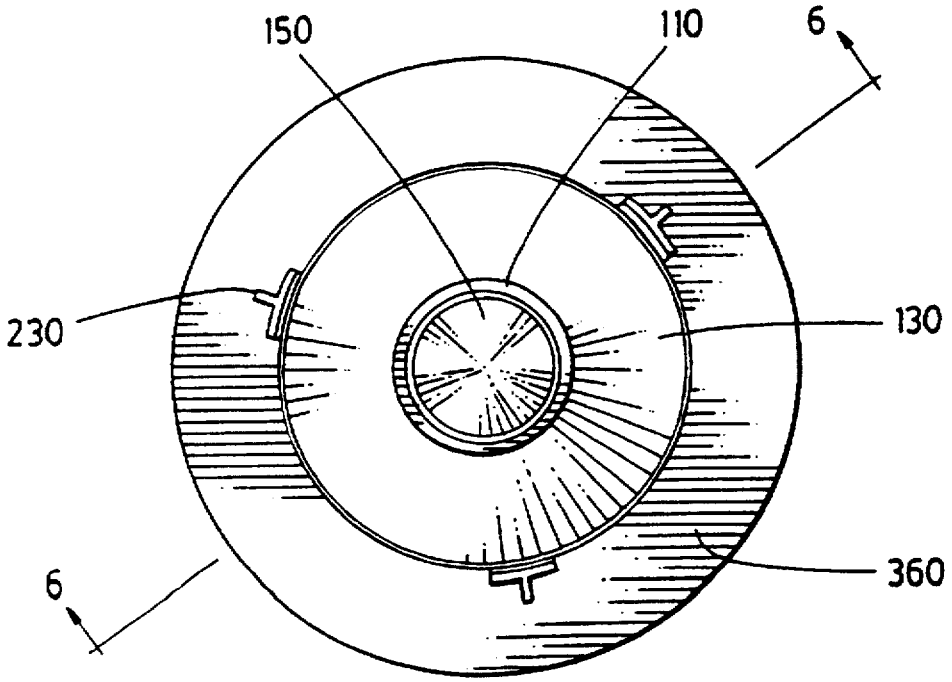
FIG. 3 is a top view of the capsule filling device of FIG. 1.
Figure 4:
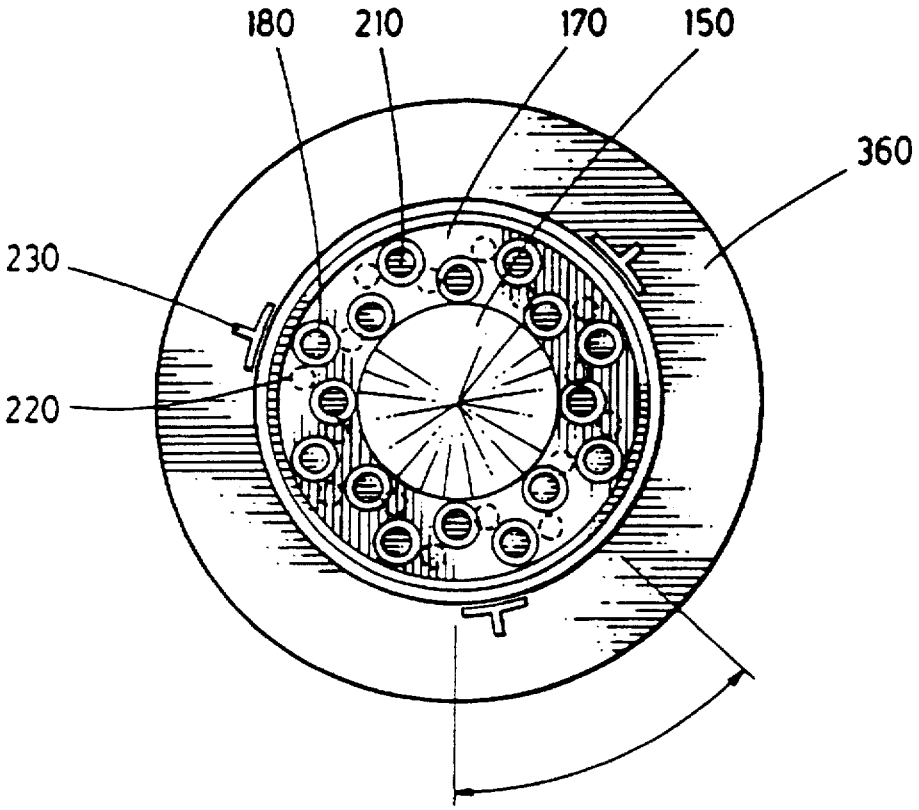
FIG. 4 is a top view of the capsule filling device of FIG. 1 with the lid removed, in release position.
Figure 5:
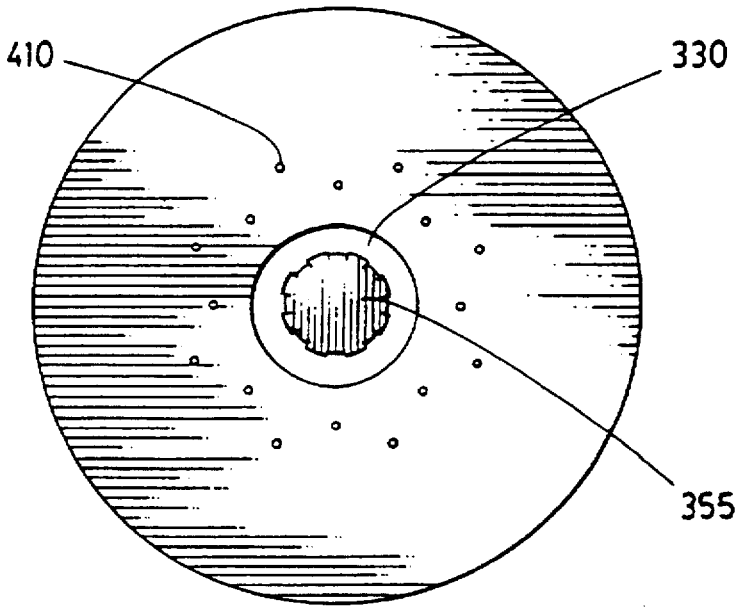
FIG. 5 is a bottom view of the capsule filling device of FIG. 1.

In the drawings, two enmbodiments of the invention are illustrated by way of example. It is to be expressly understood that the description and drawings are only for the purpose of illustration and as an aid to understanding, and are not intended as a definition of the limits of the invention.

DETAILED DESCRIPTION OF THE PREFERRED EMBODIMENTS

Figure 8:
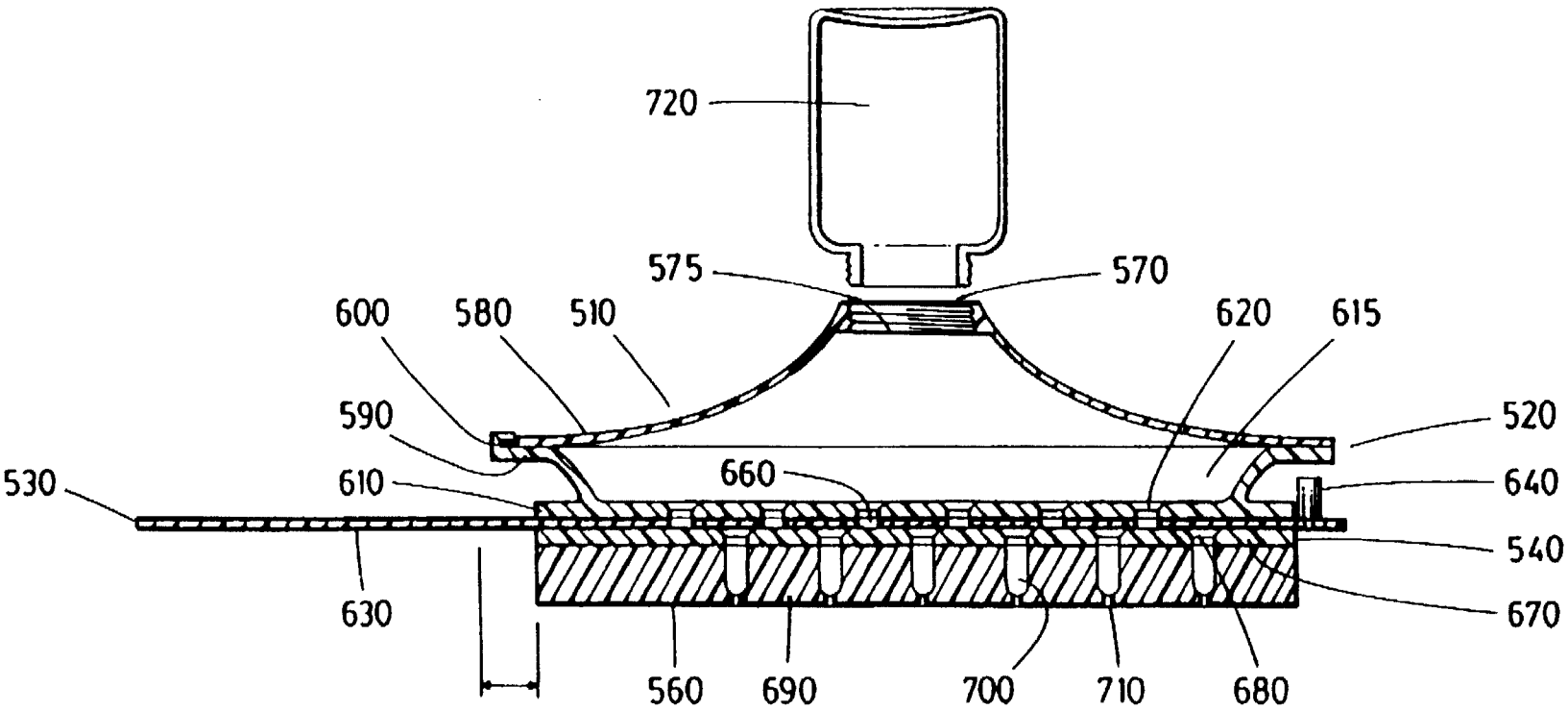
FIG. 8 is a cross-sectional view taken at line 8—8 of the capsule filling device of FIG. 7, in fill position.
Figure 9:
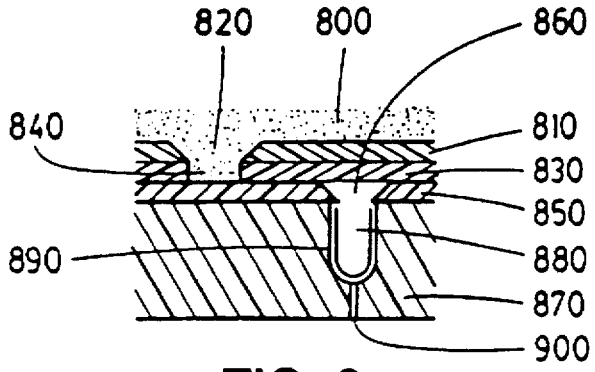
FIG. 9 is an enlarged cross-sectional view of a portion of the capsule filling devices of FIG. 4 and FIG. 8 demonstrating fill position.
Figure 10:
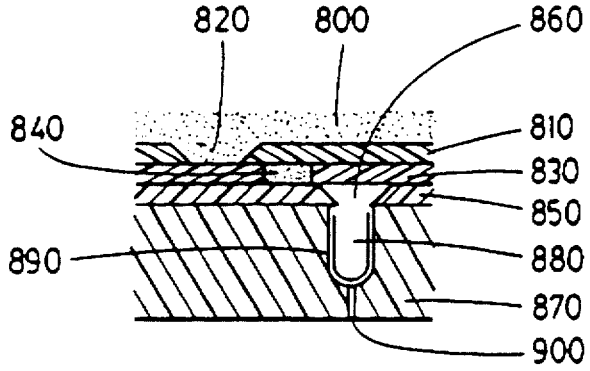
FIG. 10 is an enlarged cross-sectional view of a portion of the capsule filling devices of FIG. 4 and FIG. 8 demonstrating close position.
Figure 11:
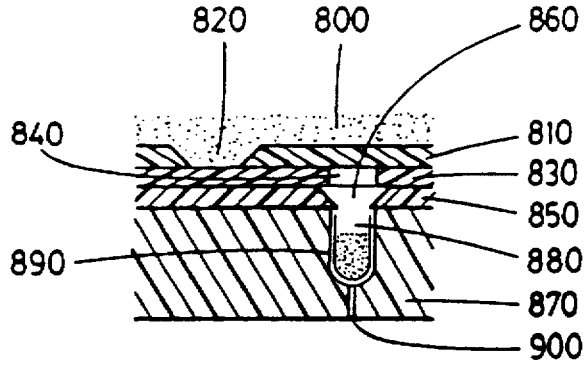
FIG. 11 is an enlarged cross-sectional view of a portion of the capsule filling devices of FIG. 4 and FIG. 8 demonstrating release position.

Two embodiments of the present invention are described below. FIGS. 1 to 6 relate to a circular capsule filling device and FIGS. 7 and 8 relate to a linear capsule filling deice. FIGS. 9, 10 and 11 relate to the operation of both the circular and linear capsule filling devices.

Figure 6:
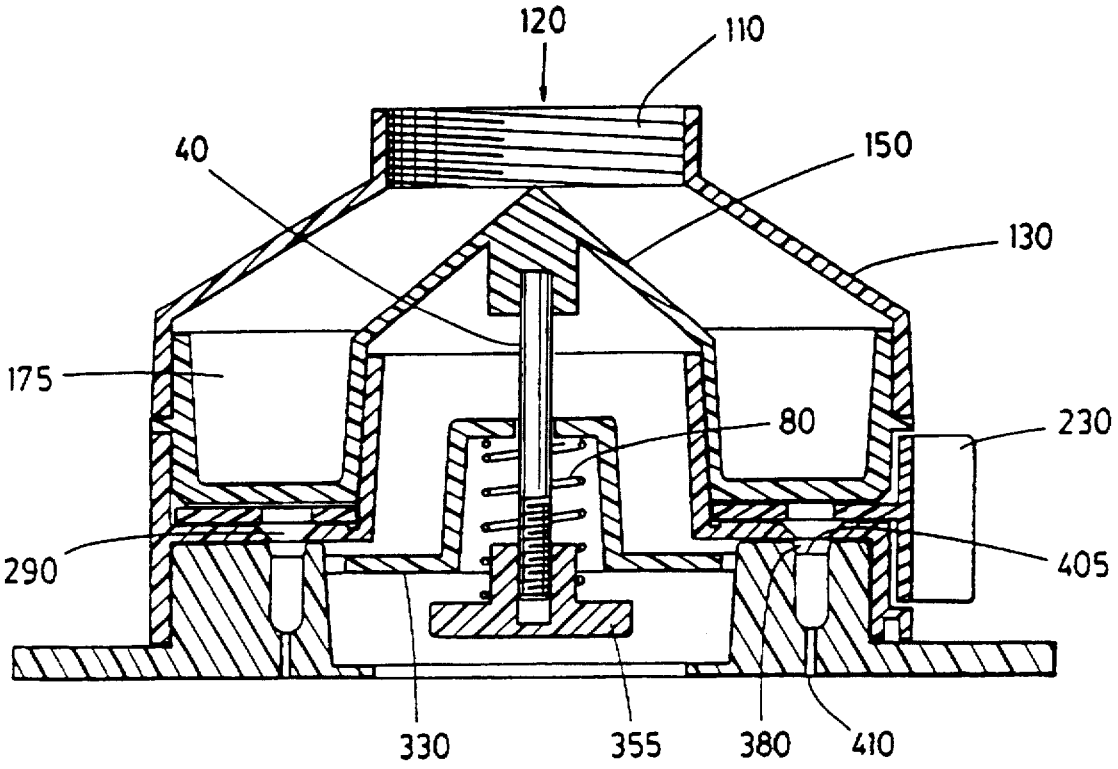
FIG. 6 is a cross-sectional view taken at line 6—6 of the capsule filling device of FIG. 3, in release position.

Referring to FIGS. 1 to 6, there is illustrated a first embodiment of the present invention. The capsule filling device 10 has a lid 20, upper housing 30, bolt 40, dosage plate 50, base plate 60, pressure plate 70, spring 80, knob 90 and capsule plate 100. Lid 20 has a threaded neck 110, lid opening 120, top wall 130 and side wall 140. The upper housing 30 has a center cone 150, side wall 160, ridge 165, base 170, reservoir 175 and channels 180. The dosage plate 50 has center wall 190 surrounding center opening 200, base 210, channels 220 and indicator levers 230. Base plate 60 has center wall 240 with grooves 245 surrounding center opening 250., side wall 260, side wall openings 270, base 280 and channels 90. The pressure plate 70 has ribbed center wall 300 with ribs 310, surrounding center opening 320, and base 330 with radiating prongs 340. Knob 90 has threaded neck 350 and grip 355. Capsule plate 100 has supporting base 360, center base 370, capsule holders 380, prong recesses 390 and center opening 400. FIG. 6 additionally demonstrates the narrow channels 410 extending downward from capsule holders 380, and the bottom half of capsules 405.

Figure 7:
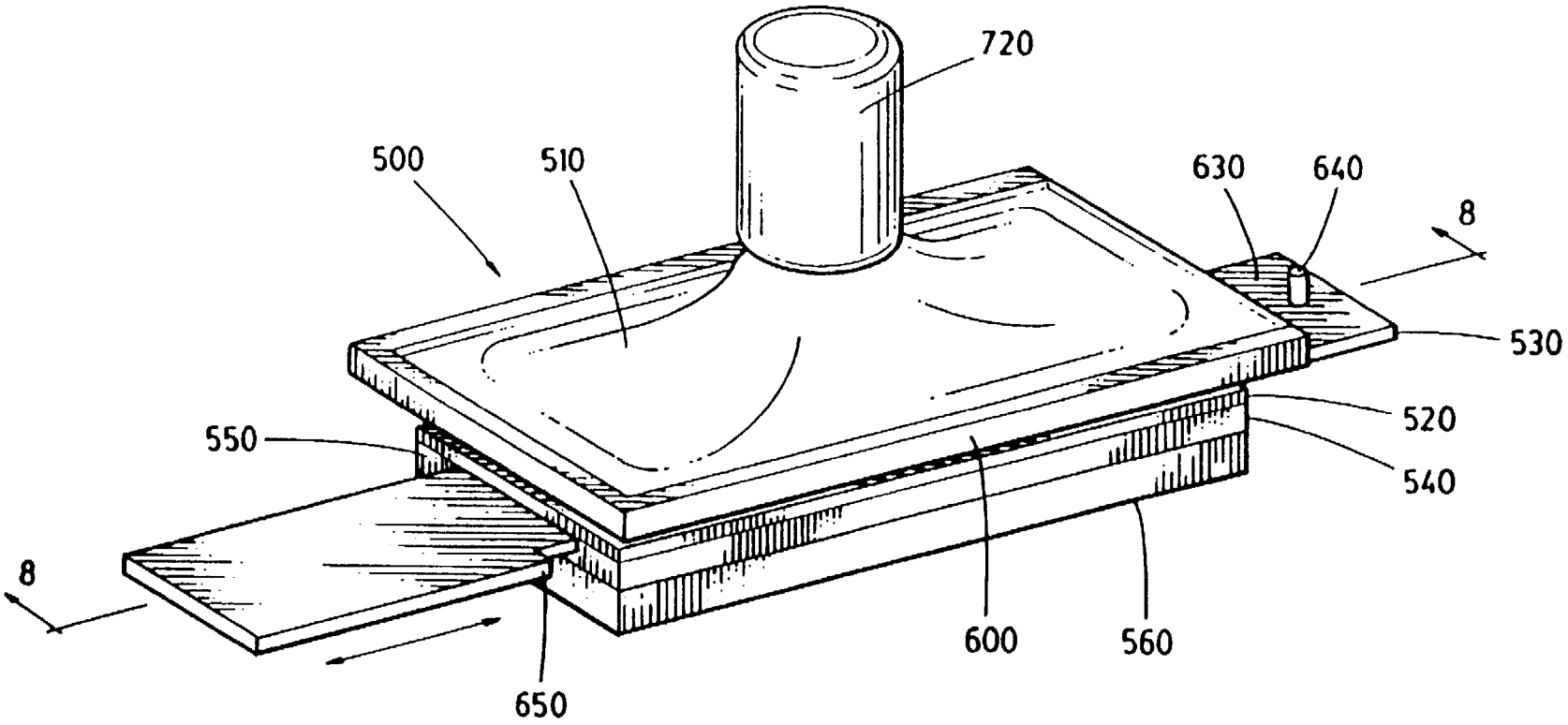
FIG. 7 is a perspective view of a further embodiment of a capsule filling device in close position.

Referring to FIG. 7, there is illustrated in a perspective view a second embodiment of the present invention. The capsule filling device 500 has a lid 510, upper housing 520, dosage plate 530, base plate 540 with base plate base plate rails 550 and capsule plate 560. Referring to FIGS. 7 and 8, the lid 510 has a threaded neck 570, center opening 575 and top wall 580. The upper housing 520 has side walls 590, lip 600, base 610, reservoir 615 and channels 620. The dosage plate 530 has base 630, stopper pin 640, stop shoulder 650 and channels 660. The base plate 540 has base 670 with thicker outer portions termed base plate rails 550 and channels 680. The capsule plate 560 has base 690, capsule holders 700 and narrow channels 710 extending downward from capsule holders 700. The attachment of a bottle 720 is also demonstrated in FIGS. 7 and 8.

Referring to FIGS. 9, 10 and 11, the three positions of a dosage plate when filling capsules with pharmaceutical substances and the like are demonstrated for the present invention. FIGS. 9, 10 and 11 illustrate a pharmaceutical powder 800, an upper housing plate 810 with channel 820, a dosage plate 830 with channel 840, a base plate 850 with channel 860 and a capsule plate 870 with capsule holders 880, capsule 890 and narrow contiguous channel 900.

When the capsule filling device of the first embodiment of the present invention is assembled, as shown in FIGS. 1 to 6, the pressure plate 70 holds the upper housing 30, dosage plate 50 and base plate 60 together, by the knob 90 screwing onto the threaded portion of the bolt 40, which bolt passes through openings 200, 250 and 320 and spring 80. The bolt 40 is securely connected to the underside of the center cone 150 of the upper housing 30. The side wall 140 of lid 20 fits over the side wall 160 of the upper housing 30 and rests on the top of ridge 165. The upper housing, dosage plate and base plate connected in this manner, the assembled plates, then rest on the capsule plate 100 by fitting prongs 340 in prong recesses 390.

When assembled, the parts of the capsule filling device are all fixed relative to each other except for the dosage plate 50, which has a limited rotational movement. In operation, dosage plate 50 is adjusted by moving indicator lever 230 so that channels 180 of the upper housing 30 are in line with channels 220 in the dosage plate, this is known as the fill position. The capsule filling device is inverted and a bottle of the desired pharmaceutical is screwed onto the threaded neck 120. (Alternatively, the neck 120 may be configured to accept a bayonet bottle neck or other type of bottle.) The capsule filling device is then flipped right side up and pharmaceutical flows, by gravity and gentle agitation into the reservoir 170 of the upper housing 30, through the funnel shaped channels 180 of the upper housing 30 into channels 220 of the dosage plate 50. After the pharnaceutical flows into the upper housing such that the channels 220 are filled, the indicator lever 230 is shifted to a midway point in the side wall opening 270 so that channels 20 in the dosage plate are out of alignment with channels 180 and channels 290. This is the closed position and at this point the desired quantity of phamaceutical is contained in the channels 220. The indicator lever 230 is finally moved to the end of the side wall opening 270 so that the channels 220 in the dosage plate 50 are in line with both the channels 290 in the base plate 60 and the capsule holders 380 of the capsule plate 100 and the pharmaceutical will fall through channels 90 into capsule holders 380. Capsule holders 380 contain the bottom half of capsules 405 which are each filled with the pharmaceutical contained in channels 220.

Capsules placed in the capsule holders may have suction applied through the narrow channels 410 to hold the capsules and enable the capsule tops to be easily removed prior to the assembled plates being place on the capsule plate. The diameter of each of narrow channels 410 is preferably about 50 to 60% of the diameter of the capsule holders. After the bottom half of the capsules are filled capsule plate 100 may be placed on a base with pins (not shown) which extend through narrow channels 410 so that the bottom half of the capsules are pushed upward so that the tops of the capsules may more easily be placed on the open capsules.

In a second embodiment of the present invention shown in FIGS. 7 and 8, the capsule filling device 500 is assembled by engagably sliding the lid 510 under the lip 600 of the upper housing 510. The base 610 of the upper housing 520 is tightly engaged to the base plate 540 by spring wound screws (not shown) through the base plate rails 550 and base 610, such that dosage plate 530 fits tightly between the base 610 of the upper housing and the base plate 540. When assembled the parts of the capsule filling device are all fixed relative to each other except for the dosage plate 530 which has linear movement. Together, these assembled plates are placed on capsule plate 560.

In operation, the capsule filling device is assembled as described above and the dosage plate 530 is inserted between base 610 of the upper housing 520 and the base plate 540 so that the pin 640 abuts the base 610. This is the fill position. The capsule filling device 500 is inverted and a bottle of pharmaceutical 720 is threaded to the neck 570. The capsule filling device 500 is then flipped right side up and the pharmaceutical flows by gravity and gentle agitation, into the upper housing reservoir 615, through the funnel-shaped channels 620 and into the channels 660 of the dosage plate 530. The dosage plate 530 is then pulled out so that the pin 640 moves away from the base 610 until the tab 650 abuts base plate rails 550 and the dosage plate can not be pulled any farther. The release position is reached when the tab 650 abuts base plate rails 550 and at this point the channels 660 of the dosage plate 530 are lined up with funnel-shaped channels 680 and also the capsule holders 700. The capsule holders 700 are filled with open capsules so that the pharmaceutical contained in channels 660 flows into each capsule at the release position. Between the fill position and the release position, the channels 660 of the dosage plate 530 are out of alignment with channels 620 so that only the quantity of pharmaceutical contained in the channel 660 flows into the capsules. Alternative methods of indicating the fill and release positions are possible, such as removable pins on both ends of the dosage plate (not shown). After use, the capsule filling device may be inverted so that the remainder of the pharmaceutical flows back into bottle 720 and bottle 720 may be removed or the device may be stored attached to the bottle.

FIGS. 9, 10 and 11 demonstrate the movement of a dosage plate 830 between the fill position and the release position. It will be noted that the midpoint position between the fill and release position is termed the close position, however, in reality there is a continuum of movement of the dosage plate between the fill and release position, rather than a definite stopping point. FIG. 9 illustrates the flow of pharmaceutical 800 into the funnel-shaped channel 820 in the upper housing plate 810 and then into channel 840 of the dosage plate 830. This is the fill position. The dosage plate is moved along to a "close" position whereby the pharmaceutical contained in the channel 840 is moved between channel 820 and channel 860 as shown in FIG. 10. FIG. 11 shows dosage plate 830 moved to the release position in which the channel 840 in the dosage plate 830 is aligned with the base plate funnel shaped channel 860 and capsule holders 880, containing capsules 890. The pharmaceutical flows into the capsules in the capsule holders.

The quantity of pharnmaceutical filled in a capsule by the two embodiments of the present invention is determined by the size of the channels in the dosage plate. The channels in the dosage plates are adjustable by using a thicker dosage plate and/or by varying the diameter of the channels. Attentively, more than one dosage plate may be used to increase the thickness of the dosage plate and thus the channels. More than one dosage plate is desirable when the material that the dosage plate is made of comes in standard thicknesses. The number of channels in the dosage plate is also adjustable and so the number of capsules to be filled at a time is adjustable. For example, the dosage plate of the linear embodiment of the present invention could contain one, two, three, four or ten rows of 7 channels each for filling 7, 14, 21, 28 or 70 capsules, respectively or it could contain one two, three or five rows of 20 channels each for filling 20, 40, 60 or 100 capsules, respectively. The present invention may also be used as a personal dispensing unit for dispensing one dose at a time as required.

In operation, filling multiple capsules with single dosages is accomplished by the repeated movement of the dosage plate from the fill to release position, replacing the filled capsules with fresh capsules in the capsule plate after each filling. Alternatively, single, double, triple etc. quantities of a pharmaceutical may be added to a capsule by repeated movement of the dosage plate from the fill to release position. In addition, more than one pharmaceutical may be added to a capsule, for example, by placing the capsule plate containing capsules filled with one pharmaceutical under another capsule filling device and adding a quantity of a second pharmaceutical. Providing all the pharmaceuticals in one capsule reduces confusion for the patient and enhances compliance in taking the medication.

The size of the capsule holders may be varied for different sizes of capsules. Preferably the size of the bottom of the funnel-shaped opening above the capsule holder should be of the same or smaller diameter than that of the capsule holder, capsules come in a variety of sizes and different types for fitting of capsule bottom to capsule top. For example the volume of a capsule may range from a volume of 0.13 to 1.37 cc and contain 78 to 1644 mg of pharmaceutical, depending on the density of the pharnaceutical. The weight of the pharmaceutical in a capsule is dependent on the volume of the channel in the dosage plate and the density of the pharmaceutical. Examples of the volume of some channels in cubic centimetres (cc) are set out in Table I below and examples of the quantity of pharmaceutical by weight (mg) is given for some combinations of volume of channel and bulk density of the pharmaceutical in Table II below.

TABLE I

| | Volume of channel (cc) | | |
|---|---|---|---|
| | Radius of Channel in Dosage Plate (cm) | | |
| Dosage Thickness (cm) | 0.35 | 0.25 | 0.15 |
| 0.4 | 0.15 | 0.08 | 0.03 |
| 0.5 | 0.19 | 0.10 | 0.04 |

TABLE II

| | Weight of Pharmaceutical in Capsule (mg) | | | | | |
|---|---|---|---|---|---|---|
| | Volume of Channel in Dosage (cc) | | | | | |
| Bulk Density (g/cc) | 0.03 | 0.04 | 0.08 | 0.10 | 0.15 | 0.19 |
| 0.6 | 16.9 | 21.2 | 47.1 | 58.8 | 92.3 | 115.4 |
| 1.2 | 33.9 | 42.4 | 94.2 | 117.7 | 184.6 | 230.8 |

The two embodiments of the present invention have a lid with a threaded neck for attachment of a bottle of pharmaceutical, however, the pharmaceutical can also be poured into the reservoir of the upper housing without attachment of the bottle. An advantage of the attachment of a pharmaceutical bottle to the neck of the lid is that the capsule filling device can be stored with the bottle of pharmaceutical attached. This avoids the need to disassemble the device and avoids any loss of pharmaceutical through washing between uses. This also prevents contamination of the pharmaceutical itself since it is only briefly opened to the environment and also prevents contamination of the environment in which the capsule filling is taking place thus preventing cross-contamination between pharmaceuticals. These are advantages over conventional manual capsule filling devices.

The channels in the upper housing and the channels in the base plate are preferably funnel shaped for better flow of the pharmaceutical and the diameter at the lower end of each funnel shaped channel is preferably the same or smaller than the diameter of the upper end of the channel below it.

The plates of the capsule filling devices of the present invention are pressed tightly together so that a clean shearing effect is created when the dosage plate is moved from the fill position to the release position. In this way the quantity of pharmaceutical delivered to each capsule and with each cycle is within an acceptable range of deviation.

The capsule filling devices of the present invention are easy to assemble and disassemble for ease of cleaning and interchangability of dosage plates. The capsule filling device may be made of machined or molded plastics or metals. Some examples of suitable plastics are acrylic, polyester, polycarbonate, acrylonitrile butadene styrene (ABS), polypropylene and acetyl. Most plastics are easily cleaned in a dishwasher and the capsule filling device may be used with a variety of different pharmaceuticals by cleaning in-between. Metals, such as, aluminum or metals with non-stick coatings and any other material suitable for contact with pharmaceuticals and the other substances to be used in this invention may also be used.

The present invention, allows pharmaceuticals to be placed in capsules without any excipients or additives. This is especially important for patients with multiple allergies and for patients with an intolerance to additives, such as, lactose. The amount of pharmaceutical added is determined by the channel in the dosage plate and not on the volume of the capsule used.

Although it is desirable to use only pure pharmaceuticals in the present invention, some pharmacuticals require conditioning in order to improve the flow characteristics. For example, the addition of silica to certain pharnmaceuticals results in improved flow.

Although the filling of capsules with pharmaceutical substances is described, the present invention is equally applicable to filling capsules with any other substance, dry or wet, which is capable of flowing into capsules using the present invention. For example, capsules could be filled with vitamins, certain holistic medicines and herbs in suitable form. The substances with which the capsules are filled may be for human or animal consumption.

The present invention could be used by pharmacists, psychiatrists, allergists, veterinarians, practitioners of holistic medicine and homeopathy and also patients for self-administration.

Examples of the operation of the circular and linear capsule filling devices with a number of different pharmaceuticals and powders are given below.

EXAMPLE 1

| | |
|---|---|
| Dosage plate thickness | 1.0 mm |
| Dosage plate channel diameter | 7.0 mm |
| Number of dosage plate channels | 16 |

A. Three separate fillings of fluoxetine provided an average weight of pharmaceutical per capsule and a standard deviation between the capsules in each filling.

| Trial | Average fill weight (mg) | Standard Deviation (mg) |
|---|---|---|
| 1 | 24.3 | 1.37 |
| 2 | 24.0 | 1.8 |
| 3 | 22.9 | 1.4 |

B. Three separate fillings of acetylsalicylic acid provided an average weight of pharnaceutical per capsule and a standard deviation between the capsules in each filling.

| Trial | Average fill weight (mg) | Standard Deviation (mg) |
|---|---|---|
| 1 | 26.2 | 2.8 |
| 2 | 24.6 | 1.8 |
| 3 | 25.4 | 2.3 |

C. Two separate fillings of ibuprofen provided an average weight of pharmaceutical per capsule and a standard deviation between the capsules in each filling.

| Trial | Average fill weight (mg) | Standard Deviation (mg) |
|---|---|---|
| 1 | 17.4 | 1.23 |
| 2 | 14.5 | 2.03 |

D. Two separate fillings of sodium chloride provided an average weight of pharmaceutical per capsule and a standard deviation between the capsules in each filling.

| Trial | Average fill weight (mg) | Standard Deviation (mg) |
|---|---|---|
| 1 | 45.5 | 2.3 |
| 2 | 45.3 | 4.1 |

EXAMPLE 2

A linear capsule filling device having the following characteristics was used:

Dosage plate thickness 4.6 mm

Dosage plate channel diameter 5.5 mm

Number of dosage plate channels 18

A. Three separate filings of acetylsalicylic acid chloride provided an average weight of pharmaceutical per capsule and a standard deviation between the capsules in each filling.

| Trial | Average fill weight (mg) | Standard Deviation (mg) |
|---|---|---|
| 1 | 89.2 | 1.3 |
| 2 | 88.8 | 1.2 |
| 3 | 89.3 | 1.0 |

B. One filling of fluoxetine provided an average weight of pharmaceutical per capsule and a standard deviation between the capsules.

| Trial | Average fill weight (mg) | Standard Deviation (mg) |
|---|---|---|
| 1 | 75.9 | 1.7 |

C. Two separate fillings of sodium chloride provided an average weight of pharmaceutical per capsule and a standard deviation between the capsules in each filling.

| Trial | Average fill weight (mg) | Standard Deviation (mg) |
|---|---|---|
| 1 | 140.1 | 1.6 |
| 2 | 140.9 | 1.6 |

D. One triple filling of sodium chloride provided an average weight of pharmaceutical per capsule and a standard deviation between the capsules.

| Trial | Average fill weight (mg) | Standard Deviation (mg) |
|---|---|---|
| 1 | 417.7 | 6.4 |

EXAMPLE 3

A linear capsule filling device having the following characteristics was used:

Dosage plate thickness 2.92 mm

Dosage plate channel diameter 5.5 mm

Number of dosage plate channels 18

A. Three separate fillings of sodium chloride provided an average weight of pharmaceutical per capsule and a standard deviation between the capsules in each filling.

| Trial | Average fill weight (mg) | Standard Deviation (mg) |
|---|---|---|
| 1 | 88.1 | 2.2 |
| 2 | 88.8 | 3.5 |

EXAMPLE 4

A circular capsule filling device having the following characteristics was used:

| | |
|---|---|
| Dosage plate thickness | 0.79 mm |
| Dosage plate channel diameter | 2.2 mm |
| Number of dosage plate channels | 16 |

A. Two separate fillings of fluoxetine provided an average weight of pharmaceutical per capsule and a standard deviation between the capsules in each filling.

| Trial | Average fill weight (mg) | Standard Deviation (mg) |
|---|---|---|
| 1 | 1.6 | 0.1 |
| 2 | 1.6 | 0.2 |

In summary, capsule filling devices are provided for delivering specific quantities of one or more pharmaceutical or other suitable substance into capsules.

Other variations and modifications of the invention are possible. All such modifications or variations are believed to be within the sphere and scope of the invention as defined by the claims appended hereto.

We claim:

1. A capsule filling device comprising:

i) an upper housing;

ii) a dosage plate;

iii) a base plate; and iv) a capsule plate; the dosage plate, the upper housing and the base plate being arranged such that the upper housing is above the dosage plate and the base plate is below the dosage plate; the base plate being in engageable connection with and above the capsule plate; the capsule plate comprising capsule holder means to receive at least one open capsule bottom; the dosage plate being slidable between a first, a second and a third position, such that the second position is located between the first position and the third position; the upper housing, dosage plate and base plate each define at least one channel, the dimension of each channel permitting a pourable substance to be passed through each channel; the channels in the base plate align with the capsule holder means in the capsule plate; in first position, the channels in the upper housing align with the channels in the dosage plate such that a pourable substance may pass through the channels in the upper housing and the channels in the dosage plate; in second position the channels in the dosage plate are not aligned with the channels in the upper housing and the channels in the dosage plate are not aligned with the channels in the base plate; and in third position the channels in the dosage plate are aligned with the channels in the base plate such that a pourable substance may pass through the channels in the dosage plate and the channels in the base plate and into the open capsule bottoms in the capsule holder means.

2. The capsule filling device of claim 1, wherein indicator means on the dosage plate indicate the first, second and third positions of the dosage plate.

3. The capsule filling device of claim 2, wherein the upper housing and base plate are secured by securing means such that the upper housing, dosage plate and base plate are in close contact.

4. The capsule filling device of claim 3, wherein the capsule filling device additionally comprises v) a lid, wherein the lid is engageably connected with and above the upper housing and the top of the lid defines a lid opening.

5. The capsule filling device of claim 4, wherein the lid opening is shaped to engageably receive a threaded bottle neck.

6. The capsule filling device of claim 4, wherein the lid opening is shaped to engageably receive a bayonet bottle neck.

7. The capsule filling device of claim 4, wherein the dosage plate has a thickness within the range of 0.1 mm to 10 mm.

8. The capsule filling device of claim 4, wherein the channels in the dosage plate have a diameter of 0.5 mm to 10 mm.

9. The capsule filling device of claim 4, wherein a second dosage plate is in connection with the first dosage plate such that the channels in the first dosage plate align with the channels in the second dosage plate.

10. The process of filling capsules with a pourable substance using the capsule filling device of claim 4 comprising the steps of:

i) inserting open capsule bottoms into the capsule holder means of the capsule plate;

ii) adjusting the dosage plate such that the indicator means indicates that the dosage plate is in the first position;

iii) passing the pourable substance through the lid opening; and iv) adjusting the dosage plate so that the indicator means indicates that the dosage plate is in the third position.

11. The capsule filling device of claim 4, wherein the dosage plate is a circular plate; the indicator means is a gripable protrusion attached to the dosage plate; and the dosage plate is rotatably slidable from first to third position by movement of the gripable protrusion.

12. The capsule filling device of claim 11, wherein the securing means comprises:

i) a bolt having a first end and a second threaded end;

ii) a pressure plate;

iii) a spring; and iv) a knob;

wherein the bolt is secured to the upper housing at the first end of the bolt; the pressure plate is placed under the base plate; the bolt passes through the center of the dosage plate, the center of the base plate and the center of the pressure plate; the spring is placed over the bolt; and the knob is threaded tightly onto the second end of the bolt.

13. The capsule filling device of claim 12, wherein the upper housing comprises a spherical cone, the apex of the spherical cone being located just below the lid opening; the channels of the upper housing being found in an annular ring around the spherical cone; the channels of the dosage plate being found in an annular ring at the perimeter of the dosage plate; the channels of the base plate being found in an annular ring at the perimeter of the base plate; and the capsule holder means being found in an annular ring at the perimeter of the capsule plate.

14. The capsule filling device of claim 13, wherein the dosage plate defines sixteen channels.

15. The capsule filling device of claim 4, wherein the dosage plate is a rectangular plate having a first and second end; the indicator means comprising a removable pin at the first end of the dosage plate and a shoulder at the second end of the dosage plate; in first position the pin preventing the dosage plate from movement in one direction and in third position the shoulder preventing the dosage plate from movement in the opposite direction.

16. The capsule filling device of claim 15, wherein the securing means comprises four spring-loaded screws securing the base plate to the upper housing, such that the upper housing, dosage plate and base plate are in close contact.

17. The capsule filling device of claim 16, wherein the lid is slidably engageable with the upper housing by a lip bordering three sides of the upper housing.

18. The capsule filling device of claim 17, wherein the dosage plate defines eighteen channels.

19. A capsule filling device comprising:

i) an upper housing;

ii) a dosage plate; and iv) a capsule plate; the dosage plate, the upper housing and the capsule plate being arranged such that the upper housing is above the dosage plate and the capsule plate is below the dosage plate; the capsule plate comprising capsule holder means to receive at least one open capsule bottom; the dosage plate being slidable between a first, a second and a third position, such that the second position is located between the first position and the third position; the upper housing and dosage plate each define at least one channel, the dimension of each channel permitting a pourable substance to be passed through each channel; in first position, the channels in the upper housing align with the channels in the dosage plate such that a pourable substance may pass through the channels in the upper housing and the channels in the dosage plate; in second position the channels in the dosage plate are not aligned with the channels in the upper housing and the channels in the dosage plate are not aligned with the capsule holder means in the capsule plate; and in third position the channels in the dosage plate are aligned with the capsule holder means in the capsule plate such that a pourable substance may pass through the channels in the dosage plate and into the open capsule bottoms in the capsule holders means.

* * * * *